United States Patent [19]

Ruud

[11] Patent Number: 4,597,534

[45] Date of Patent: Jul. 1, 1986

[54] POWDER SPRAY WITH THE ABILITY TO CHARGE ELECTROSTATICALLY

[76] Inventor: Jan Ruud, Fregattgränd 1, 440 74 Hjälteby, Sweden

[21] Appl. No.: 790,635

[22] PCT Filed: Apr. 22, 1982

[86] PCT No.: PCT/SE82/00129

§ 371 Date: Dec. 23, 1982

§ 102(e) Date: Dec. 23, 1982

[87] PCT Pub. No.: WO82/03573

PCT Pub. Date: Oct. 28, 1982

Related U.S. Application Data

[63] Continuation of Ser. No. 456,026, Dec. 23, 1982, abandoned.

[30] Foreign Application Priority Data

Apr. 24, 1981 [SE] Sweden ..... 8102606

[51] Int. Cl.[4] ..... B05B 5/02

[52] U.S. Cl. ..... 239/704

[58] Field of Search ..... 239/3, 690, 692, 704, 239/705, 706, 708

[56] References Cited

U.S. PATENT DOCUMENTS

| | | | |
|---|---|---|---|
| 2,739,838 | 3/1956 | Sedlacsik | 239/706 |
| 3,421,693 | 1/1969 | Fraser | 239/706 |
| 3,735,925 | 5/1973 | Benedek et al. | 239/706 |
| 4,139,155 | 2/1979 | Hastings | 239/708 |
| 4,227,652 | 10/1980 | Itoh | 239/706 |

FOREIGN PATENT DOCUMENTS

| | | | |
|---|---|---|---|
| 1330178 | 5/1963 | France . | |
| 2082706 | 12/1971 | France . | |
| 197445 | 7/1967 | Sweden . | |
| 352495 | 12/1972 | Sweden . | |
| 397167 | 1/1973 | Sweden . | |
| 371967 | 11/1973 | Sweden . | |
| 1153868 | 5/1969 | United Kingdom | 239/708 |
| 1482084 | 8/1977 | United Kingdom . | |
| 2066703 | 7/1981 | United Kingdom | 239/708 |
| 504560 | 4/1976 | U.S.S.R. | 239/706 |

*Primary Examiner*—Joseph F. Peters, Jr.
*Assistant Examiner*—Michael J. Forman

[57] ABSTRACT

A powder sprayer to be charged electrostatically, comprising a plurality of elongated, curved charging ducts made of an electrically non-conducting material and coated with an electrically-conducting layer over part of their length and connected via a lead to earth or to a voltage source, so that when the sprayer is used the powder material is charged by close contact with the internal walls of the ducts as it passes through the charging ducts. The ducts are curved around to form at least one loop and/or undulation with their longitudinal center plane extending substantially in the supply direction of the powder.

8 Claims, 9 Drawing Figures

POWDER SPRAY WITH THE ABILITY TO CHARGE ELECTROSTATICALLY

This application is a continuation of application Ser. No. 456,026, filed Dec. 23, 1982 now abandoned.

BACKGROUND OF THE INVENTION

The present invention relates to a powder sprayer with the ability to charge electrostatically, consisting of a plurality of elongated, curved charging ducts made of an electrically non-conducting material such as a plastic material, for example, which are coated with an electrically conducting layer over part of their length, wherein the coating layer can be connected to a lead extending therefrom and intended to be connected to earth or to a voltage source, so that when the spray is being used the powder material is charged by close contact with the internal walls of the ducts as it passes through the charging ducts.

The main aim of the present invention is to provide a powder sprayer of the above-mentioned type which, in addition to functioning faultlessly and charging the powder effectively, is also compact, due to the fact that it enables charging ducts of considerable length to be disposed in a small space.

SUMMARY OF THE INVENTION

The aim is achieved with a powder sprayer according to the present invention which is primarily characterised in that the ducts are curved to form at least one loop and/or a curve with its longitudinal central plane extending substantially in the supply direction of the powder.

BRIEF DESCRIPTION OF THE DRAWINGS

The invention is described in the following with reference to the accompanying drawings, on which

DETAILED DESCRIPTION OF PREFERRED EMBODIMENTS

Figure 2:
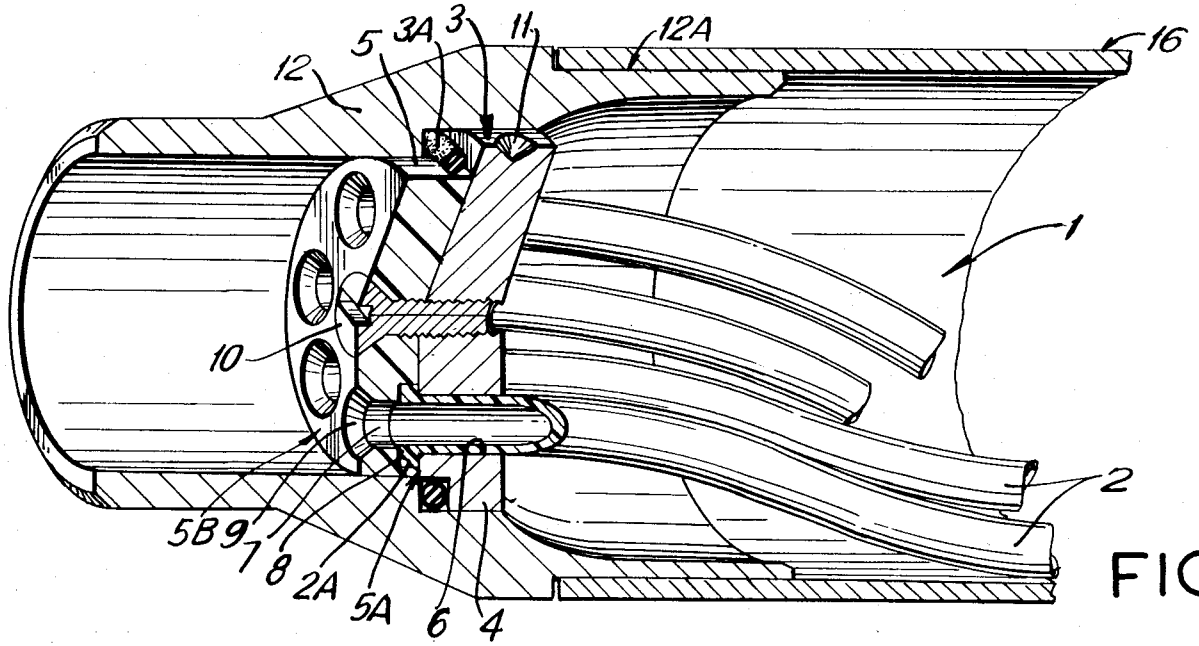
FIG. 2 shows the rear end of the sprayer in a partially sectioned view.

A powder constructed according to the invention which has the ability to charge electrostatically and which is designated with the numeral 1 on the drawings is formed by a plurality of elongated charging ducts 2 made of electrically non-conducting material. Suitable materials are plastics, for example, or other similar materials. The charging ducts 2, which are appropriately coated over part of their length with an electrically-conducting layer such as metal, are accommodated via one of their respective ends, preferably their rear end, in a core 3. The core 3 which is exemplified on the drawing in FIG. 2 is formed of two circular plates 4 and 5 which have a number of openings 6 and 7 respectively round their periphery, distributed in a circle and corresponding to the number of ducts 2, being adapted to the said charging ducts 2. The openings 6 in one core plate 4 form passageways 6 for the respective ducts 2 and this plate 4 is made of a material which is electrically conducting, such as aluminum, for example. The openings 7 in the other core plate 5 which is expediently manufactured from a plastic material have a shape such that the ends 2A of the tubular ducts 2, which are distorted after they have been inserted through the openings 6 in the other plate 4, can be accommodated therein in that, for example, the plate 5 is provided with larger bores 8 on the side 5A of the plate 5 which lies against the plate 4. On the other side 5B of the plate 5, i.e. the side 5B which is furthest away from the plate 4, the openings 7 have, for example, funnel-shaped outlets 9 to allow the powder to pass in through the openings 7 into the tubes 2. The plate 5 is expediently attached to the plate 4 by means of a screw 10 as shown on the drawing in FIG. 2. The plate 4 has a connection 11 with which the sprayer can be connected to earth or to a voltage source via a line which is not shown on the drawing, and connected to the coating on the charging ducts 2.

A seal in the form of an O-ring 3A, for example, is arranged to rest between the core 3 and a sleeve-type connection 12 which is designed to be used for connecting the powder sprayer 1 to a powder-supplying hose or the like.

Figure 3:
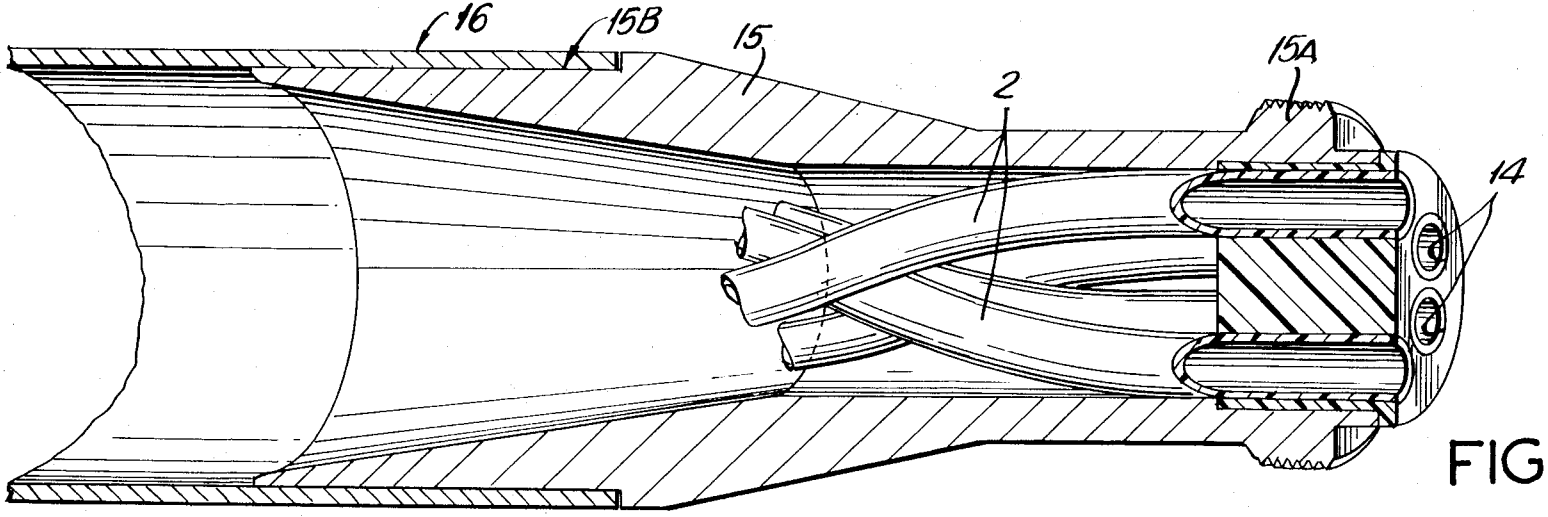
FIG. 3 shows the front end of the sprayer in a partially sectioned view.

As shown in FIG. 3, the other ends of the ducts 2, i.e. the end which are furthest forwards, viewed in the transportation direction of the powder, are accommodated in another core 13. This other core 13, which is expediently also made of a plastic material, similarly has passage holes 14 distributed in a circle around its periphery, corresponding in number to the number of charging ducts 2 and adapted to the respective charging ducts 2, as can be seen in FIG. 3.

The said core 13 is supported by a front sleeve-type connecting part 15, which is equipped with a threaded part 15A designed to be used for connecting the sprayer to a dispersing nozzle, for example.

Figure 1:
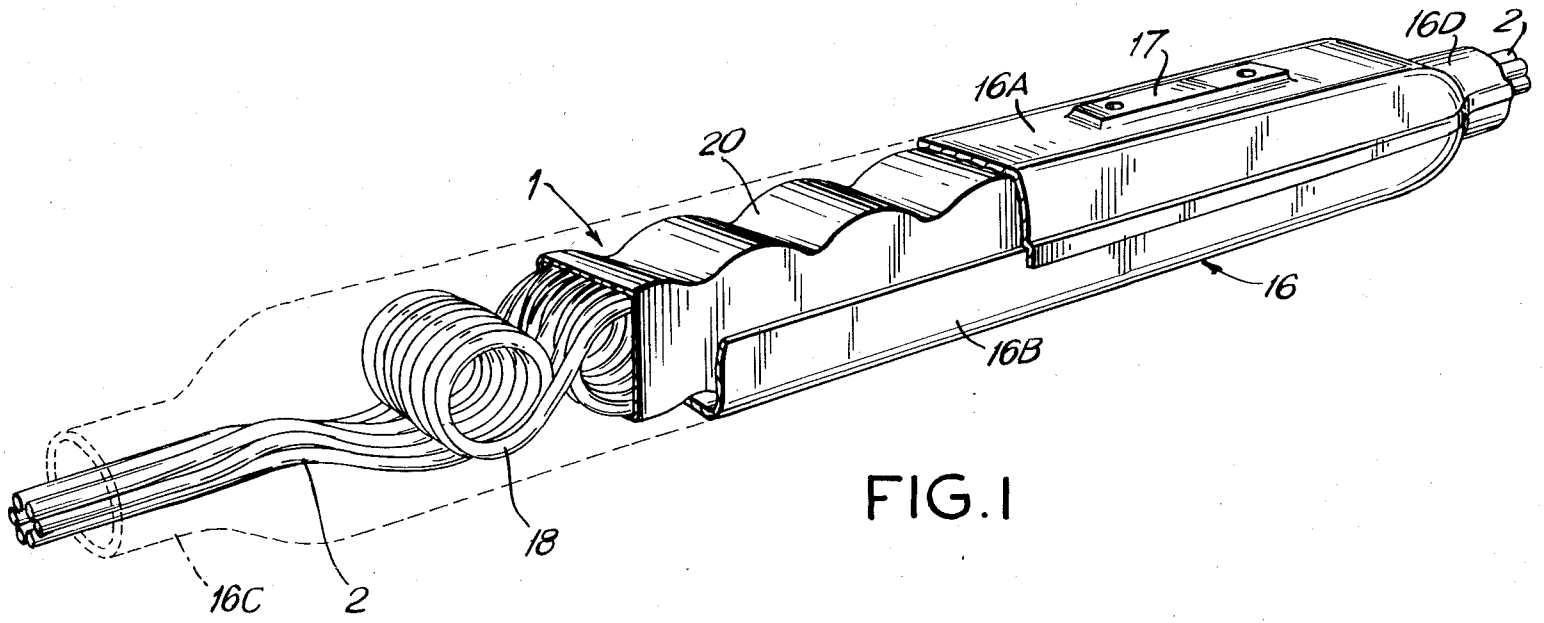
FIG. 1 shows a partially sectioned perspective view of a powder sprayer constructed according to the invention.

As is clearly shown in FIG. 1, the charging ducts 2, the connecting parts 12, 15 and the other associated parts can be enclosed in a preferably box-shaped casing 16, which is formed in the example shown here of two parts 16A and 16B with respective joining surfaces disposed in the longitudinal direction of the sprayer 1. The ends 16C and 16D of the casing 16 are drawn in somewhat so that the connecting parts 12, 15, which can be provided, for example, with their own respective stop-type parts 12A and 15B, can be accommodated in their respective ends 16C, 16D of the casing 16.

A fixing 17 is expediently attached to the casing 16 and is designed to be used when the sprayer is to be supported on and manipulated via a manipulator, for example, or a similar device.

The characteristic feature of the present invention is the way in which the charging ducts 2 are curved.

Figure 9:
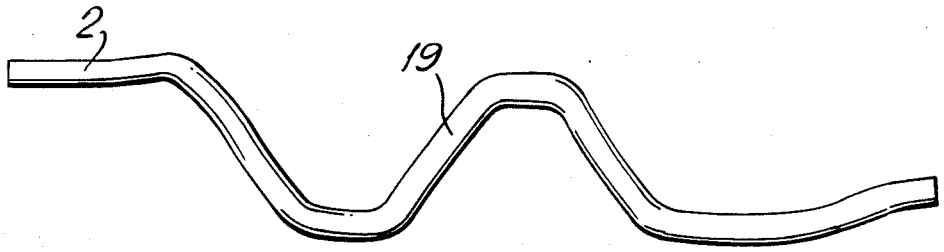
FIG. 9 shows a charging duct curved in an undulating formation.

In the embodiment examples which are shown in FIGS. 1–8 the respective ducts 2 are curved so that they form at least one loop 18, while a duct 2 which is shaped to form at least one undulation 19 is shown in the embodiment example in FIG. 9.

Figure 4:
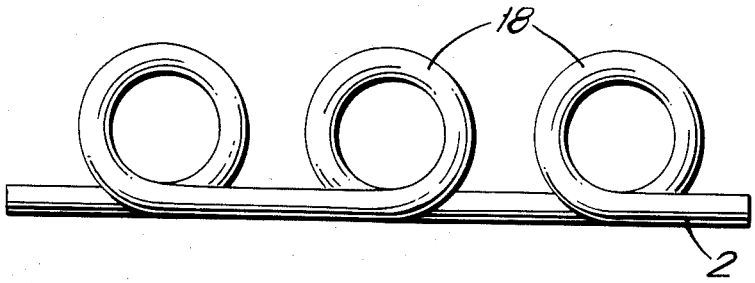
FIGS. 4–8 show various embodiment examples of possible loop formations for the charging ducts.

FIG. 4 shows how a duct 2 is curved so that it forms a plurality of loops 18 arranged in sequence one after the other, having a regular formation.

Figure 5:
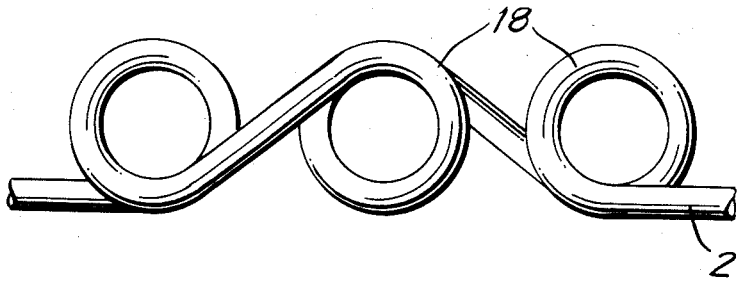

In FIG. 5 an embodiment is shown where the loops 18 are curved so that the transportation direction for the powder in them is reversed in the adjoining successive loops 18.

Figure 6:
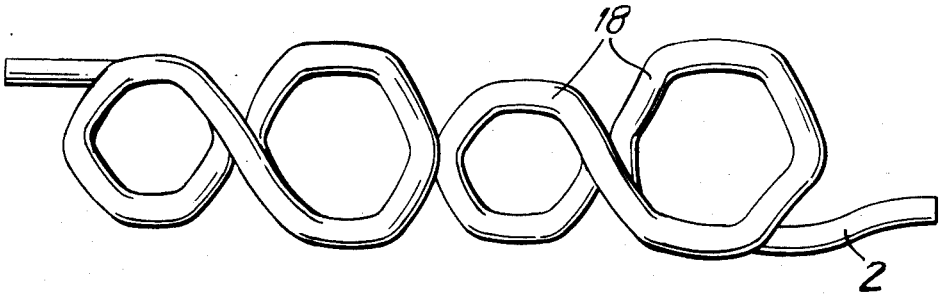

FIG. 6 shows an arrangement of the loops 18 similar to that which is shown in FIG. 5 except that certain loops 18 are given differently-sized curvature diameters.

Figure 7:
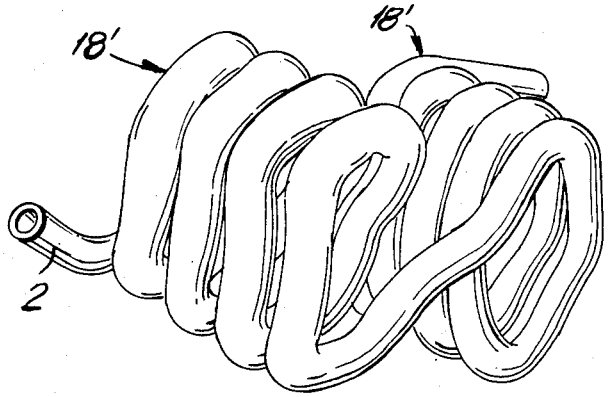
Figure 8:
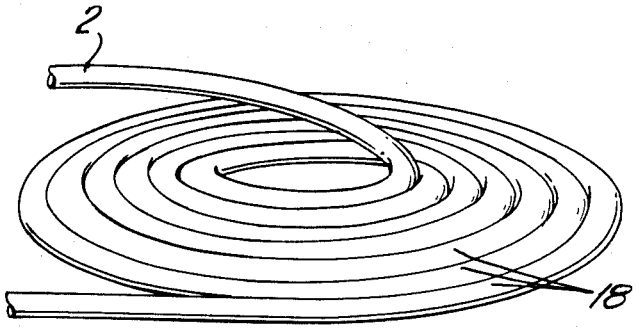

FIG. 7 shows an embodiment where a plurality of loops 18 disposed transverse to the transportation direction of the powder form groups 18[1] of loops 18 which are displaced sideways relative to each other, viewed in the transportation direction, but are still arranged to form a continuous powder duct 2.

It is also possible to bend the charging duct 2 so that a plurality of loops 18 forms a spiral, with the loops 18 disposed closely adjacent to each other. Also the curving of the duct 2 into an undulating formation 19 may be varied in a large number of ways. The longitudinal central plane of the respective loops 18 and undulations 19 extends substantially in the supply direction of the powder in all the embodiment examples.

In order to increase further the charging capacity of the sprayer 1 an electrically-conducting layer of metal foil, for example, may be wrapped round the curved ducts 2. A protective layer of plastic film, such as heat-shrunk film 20, for example, may also be disposed around the charging ducts 2 when these are made into a single unit, as shown in FIG. 1.

The functioning of a powder sprayer as described above, which can be used, for example, for charging coloring powder, is as follows. The rear end 12 of the sprayer 1 is connected by means of a hose to a powder container so that coloring powder, for example, can be transported with the air of a stream of air to the sprayer 1 and through the ducts 2. During this process, due to the loops and/or undulating curves of the ducts 2, the powder comes into close contact with the internal walls of the ducts 2, and due to the fact that the ducts 2 are connected to earth or a voltage source, is charged effectively over the whole of the surface of the powder. Due to the fact that the powder is flung towards the internal walls of the respective ducts 2, and especially if the loops 18 change direction, virtually all the powder comes into contact with the walls and is charged, which has not been the case with the sprayers known until now.

The charged powder is then supplied through the connecting part 15 and onwards out of the sprayer 1 through the dispersion nozzle and, due to the fact that it has been charged, it strives to seek out the object which it is desired to coat with the powder. In particular, sites on the object which are hard to reach can be coated effectively with the powder.

The invention is not restricted to the embodiments which are described above and are shown on the drawings merely by way of example, but it may be modified with regard to its details within the scope of the following Patent Claims.

I claim:

1. A sprayer comprising: a plurality of elongated tubular ducts of an electrically non-conducting material enclosed by a layer of an electrically conducting material over part of their length, inlet means for conducting powder into said ducts, outlet means for conducting powder out of said ducts and nozzle means associated with said outlet means for receiving powder from said outlet means and directing said powder toward a surface to be coated, means connected to said layer for electrically charging powder material when passing through said ducts by contact with internal walls of the ducts, said ducts being arranged essentially parallel to each other, with each duct having a longitudinal axis extending essentially in a plane containing the flow direction of the powder and having a plurality of loops in said plane with adjacent loops in each duct being wound in opposite directions so the transportation direction for powder passing through the duct is reversed in adjacent successive loops.

2. A sprayer according to claim 1, wherein said ducts are enclosed in a stocking-like casing.

3. A sprayer according to claim 2, wherein said stocking is of electrically conducting material.

4. A sprayer according to claim 1, wherein said ducts are accommodated in a common housing of separable parts.

5. A sprayer according to claim 4, wherein said housing has ends forming devices for holding said ducts separate from each other.

6. A sprayer according to claim 5, wherein said holding devices hold and enclose respective ends of the ducts in a circle.

7. A sprayer according to claim 6, wherein one of said holding devices comprises two parts with holes, at least one part consisting of a metal and connected to said electrically-conducting material.

8. A sprayer according to claim 7, wherein one of said two parts has a recess, a seal in said recess co-acting with a holding part and with flanges on said duct ends.

* * * * *